US008334766B2

(12) United States Patent
Terán-Matus et al.

(10) Patent No.: US 8,334,766 B2
(45) Date of Patent: Dec. 18, 2012

(54) TRACKING SYSTEM

(75) Inventors: Jose-Adalberto Terán-Matus, Nuevo León (MX); Martin Hernández-Rodriguez, Nuevo León (MX)

(73) Assignee: RFID Mexico, S.A. de C.V., Nuevo Leon (MX)

( * ) Notice: Subject to any disclaimer, the term of this patent is extended or adjusted under 35 U.S.C. 154(b) by 840 days.

(21) Appl. No.: 12/416,344

(22) Filed: Apr. 1, 2009

(65) Prior Publication Data

US 2010/0253506 A1 Oct. 7, 2010

(51) Int. Cl.
*G08B 1/08* (2006.01)

(52) U.S. Cl. ..... 340/539.13; 340/539.11; 340/539.2; 340/573.4; 379/37

(58) Field of Classification Search ..... 340/539.1, 340/539.11, 539.13, 539.16, 539.2, 573.1, 340/573.4; 379/37
See application file for complete search history.

(56) References Cited

U.S. PATENT DOCUMENTS

2008/0068157 A1* 3/2008 Ikemori et al. ..... 340/539.23

* cited by examiner

*Primary Examiner* — Travis Hunnings
(74) *Attorney, Agent, or Firm* — Young & Thompson

(57) ABSTRACT

A tracking system for tracking the location of a plurality of persons, objects and groups of persons or objects or combination of persons and objects which allows creating person or object communities (such as vehicles, objects having a high monetary value or objects that continuously need to be monitored such as guns or medical equipment) and keep tracking of the communities in real time worldwide, as well as registering a tracking history of each person or object and creating customized monitoring zones worldwide and tracking rules for setting customized alarms, for example when the distance among one or more members of the group or members of different groups are greater or lesser than an predetermined value when a member of the group exits a predetermined area or is near a predetermined area or when a person or object remains in a single spot for more or less than a predetermined period of time, which is useful for monitoring the security of a person or object.

15 Claims, 1 Drawing Sheet

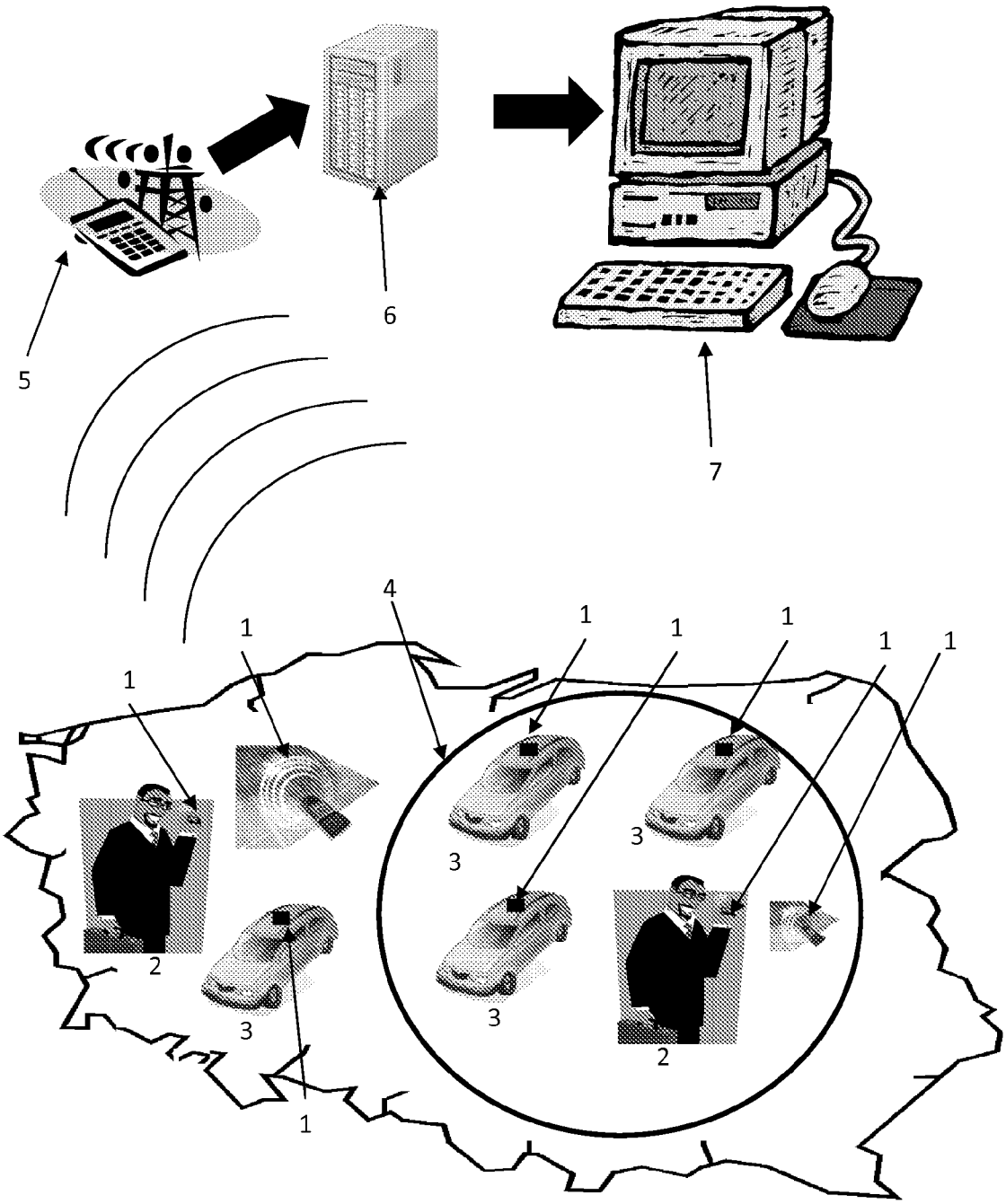
5
6
7
4
1
1
1
1
1
1
1
2
3
3
3
3
2
1

TRACKING SYSTEM

BACKGROUND OF THE INVENTION

A. Field of the Invention

The present invention is related to tracking systems for tracking persons or objects inside a predetermined geographical area and more particularly to a system for tracking objects or persons or customized groups of objects or persons worldwide in real time, including the inside of buildings, and perform several tracking functions.

B. Description of Related Art

With the advent of localization (locating) equipment using different technologies such as GPS, RFID, and other localization technologies which help to locate an object or person by triangulation, sensing or signal strength among others, it is very common to be able to locate individual objects and persons either inside some facilities or even worldwide.

However it is sometime necessary to keep tracking a plurality of objects or persons at the same time in real time and from a remote place, for example a group of kids inside a school and getting alerts every time a member of the family exits the school or any other predetermined area.

Furthermore, sometimes it is required to monitor a group of persons in different changing places during predetermined periods of time and getting alarms if one member of said group exits one of said places. The current systems allow to monitor predefined areas, but do not allow to create customized monitoring areas worldwide neither create customized monitoring areas inside buildings.

U.S. Patent application No. 20080068157 discloses a communication control system which includes a monitoring terminal held by each of a plurality of persons to be monitored and an information managing apparatus for managing position information on the monitor terminal. The monitor terminal has a position information obtaining unit for obtaining geographical position information, a group setting unit for setting a group of monitor terminals of persons to be monitored who are allowed to be mutually grouped, and a first transmitting unit for transmitting the obtained position information and group setting information to the information managing apparatus. The information managing apparatus has a first receiving unit for receiving the position information and the group setting information, a management information storing unit for storing attribute information on the person to be monitored and a condition for determining a monitor level of the person to be monitored, a mutual distance recognizing unit for calculating a distance between the monitor terminals from the position information, and a monitor level determining unit for determining the present monitor level based on the calculated distance, the attribute information, and the monitor level determination condition.

Although it is disclosed that the system can manage groups of persons to be monitored, it does not disclose that the system can notify alerts if a persons exits a predetermined customized area since it discloses notifications of "monitoring" levels of the monitored persons and neither discloses means for customizing monitoring areas worldwide or inside buildings.

In view of the above referred problems, applicant developed a tracking system for creating person or object communities (such as vehicles, objects having a high monetary value or objects that continuously need to be monitored such as guns or medical equipment) and keep tracking of said communities in real time worldwide, as well as registering a tracking history of each person or object.

The tracking system of the present invention also allows creating customized monitoring zones worldwide and tracking rules for setting customized alarms, for example when the distance among one or more members of the group or members of different groups are greater or lesser than an predetermined value, when a member of the group exits a predetermined area or is near a predetermined area or when a person or object remains in a single spot for more or less than a predetermined period of time, which is useful for monitoring the security of a person or object.

Thanks to the high degree of customization of the tracking system of the present invention, it can be adapted to be used in several service areas such as scholar, security, military, medical, etc.

SUMMARY OF THE INVENTION

It is therefore a main object of the present invention to provide a tracking system for creating persons, objects or combination of objects and persons communities (such as vehicles, objects having a high monetary value or objects that continuously need to be monitored such as guns or medical equipment) and keep tracking of said communities in real time, worldwide.

It is another main object of the present invention to provide a tracking system of the above referred nature which allows registering a tracking history of each person or object.

It is a further object of the present invention to provide a tracking system of the above referred nature which allows creating customized monitoring zones worldwide and tracking rules for setting customized alarms.

It is an additional object of the present invention to provide a tracking system of the above referred nature which is highly customizable and which can be adapted to be used in several service areas such as scholar, security, military, medical, etc. allowing to the user to perform a research of objects or persons movements in a specific range of dates and times tracing the movements in a map and tracing objects or persons that moved or placed close to the object or person of interest in certain range of time and distance.

It is an additional object of the present invention to provide a local or worldwide tracking system of the above referred nature for identifying a plurality of traceable persons or objects in certain area who ask for certain assistance and define the algorithms for prioritizing the way to attend or serve such objects or persons.

These and other objects and advantages of the worldwide tracking system of the present invention will become apparent to those persons having an ordinary skill in the art, from the following detailed description of the embodiments of the invention which will be made with reference to the accompanying drawings.

BRIEF DESCRIPTION OF THE DRAWINGS

FIG. 1 is a schematic view of the tracking system of the present invention.

DETAILED DESCRIPTION OF THE INVENTION.

The tracking system of the present invention will be described making reference to the accompanying drawing and to a preferred embodiment of the invention. In a preferred embodiment, the tracking system of the present invention is used to track a plurality of persons or objects and groups of persons or objects or combination of persons and objects.

With reference to FIG. 1, the worldwide tracking system comprises:

one or more localizing means 1 associated to one person 2, object 3 or group of persons and/or objects 4, such as GPS, cellular phones, RFID chips, etc., said localizing means 1 wirelessly 5 connected to a network 6 such as internet or an intranet and sending localization information to said network 6 for being retrieved by any computer 7 connected to said network, wherein each person 2 or object 3 may carry one or more types of localizing means;

data processing means comprising a computer 7 having:

a database;

displaying means such as a screen;

a computer program for accessing said network 6 such as internet or an intranet;

a computer program for adding said localizing means 1 to a list of monitored localizing means by entering assignation data of each of the localizing means 1 to be added;

a computer program for monitoring said monitored localizing means 1 and obtaining localization information from said network 6;

a computer program for creating groups 4 of persons 2, objects 3, or groups 4 of objects 3 and persons 2;

a computer program for creating associations between monitored localizing means 1 and said groups 4 of persons 2, objects 3, or groups 4 of objects 3 and persons 2 for monitoring the localization of associated groups 4 of persons 2 and/or objects 3;

a computer program for creating a worldwide virtual geographical grid including worldwide coordinates;

a computer program for downloading publicly available electronic worldwide maps from the network 6 or local databases, and selecting a specific map in order to overlay said map over the virtual geographical grid;

a computer program for displaying said selected map overlaying the virtual geographical grid by means of the displaying means, wherein the computer program for displaying said selected map having a computer subprogram that allows to zoom in and out from said map;

a computer program for editing said selected map in order to add custom virtual items such as buildings or specific maps from the interior of buildings and any other objects, and save said objects as a part of a group of objects or individually in said computer database, so that the objects can be added or deleted from the map when necessary;

a computer program for displaying the localization information of each monitored localizing means 1 in the selected map in real time, said program, also displaying a trajectory path for the moving monitored localizing means 1 in real time;

a computer program for monitoring the associations between a person 2, object 3 or a group 4 and one or more localizing means 1 and keep tracking of a specific person 2 object 3 or group 4 when an associated localizing means 1 stop sending a localization signal and other alternative associated localizing means 1 start to emit a localization signal, by representing in the map the location of said alternative localization means 1 and the person 2, object 3 or group 4 associated thereof, such as when a person 2, object 3 or group 4 being tracked by GPS enters a building and the GPS signals are blocked by the walls of the building and RFID chips begin to be tracked inside the building by RFID reading means and said RFID reading means begin to send a localization signal;

a computer program for calculating distances between persons 2, groups 4 or objects 3 associated with monitored localizing means 1, virtual items or places displayed in said selected map;

a computer program for registering and storing in the database the localization history of each monitored localization means 1 and each monitored localization means 1 that is associated to a person 2, object 3 or group 4;

a computer program for displaying the registered localization history of each monitored localization means 1 and each monitored localization means 1 that is associated to a person 2, object 3 or group 3 by displaying a path representing said registered localization history in the selected map by means of the displaying means. Said computer program for displaying the registered localization history also displaying the registered path of selected monitored localization means 1 in accordance with a period of time or dates to view the registered path between the selected times or dates. Said computer program for displaying the registered localization history also showing a real time trajectory path of one or more monitored localization means 1 and at the same time showing the historic trajectory path of selected monitored localization means 1 in order to compare said trajectory paths. The velocity at which the historic trajectory paths are displayed can be configured and also the distance resolution in which the historic trajectory paths are displayed can be also configured in order to show the movement of the monitored localization means every predetermined unities of distance. Also based on said localization history, the computer program for displaying the registered localization history can display at a request from users, the monitored localization means 1 that were near one or more selected localization means 1 at a predetermined time or date or between a selected period of time and date;

a computer program for creating user virtual accounts in the system, each virtual account including: a list of the monitored localization means 1 and monitored localization means 1 associated to person 2, objects 3 or groups 4 of persons 2 or objects 3 or groups 4 of persons 2 and objects 3 that the user wants to monitor, rules for sending alarms, preferences regarding the way the account is accessed by the user or by other users, such as authorizations to other users to gain access to the account;

a searching program for searching one or more persons 1 or objects 3, or groups 4 of persons 2 or objects 3 or groups 4 of persons 2 and objects 3 associated to monitored localization means 1 or search for specific monitored localization means 1 or groups 4 of localization means 1, requesting any key word identifying a person 2 object 3 or group 4 or the identify information of a monitored localization means 1. The searching program will display the search results and users may request authorization to access the stored data about the one or more persons 2 or objects 3, or groups 4 of persons 2 or objects 3 or groups 4 of persons 2 and objects 3 associated to monitored localization means 1 obtained by the searching program—such as identifying information, current localization, localization history, etc.—;

a program for controlling requests from other users to access localization information of the persons 2, objects 3 or groups 4 of persons 2 or objects 3 or groups 4 of persons 2 and objects 3 assigned to monitored localization means or specific localization means, such as allowing access to certain users with or without authorization;

a program for creating distance associations between persons 2, objects 3 and/or groups 4 and creating rules based on said distance associations;

a program for generating an alarm if there is a violation of rules based on said distance associations such as generating an alarm if said persons 2, objects 3 or groups 4 move closer or away a predetermined distance from each other, immediately or after the violation to the rule has repeated a predetermined number of times;

a program for creating restriction zones in the map for associating one or more persons 2, objects 3 or groups 4 to said created restriction zones and creating rules based on said restriction zones;

a program for generating an alarm if there is a violation of rules based on said restriction zones, such as when one or more persons 2 of a group 4 leave the restricted zone at certain times or days or when other persons 2, objects 3 or groups 4 associated with monitored locating means that do not pertain to said group 4 enter the restricted zone;

a program for creating multiple rules involving persons 2, objects 3, groups 4, monitored localization means 1, times, dates, places, restricted zones of one or more user accounts, such as rules comprising establishing distance limits among persons 2 during certain times and dates, or establishing that one or more persons or groups have to be present in a predefined zone before, at or after a certain time or date;

a program for generating an alarm and for automatically sending said alarm via e-mail, SMS message or any other notification means to one or more recipients if said multiple rules are violated;

Although in the preferred embodiment of the invention it was described that the system keeps tracking of persons 2, objects 3 and groups 4, in other embodiments it may be possible to keep tracking of any moving object or groups of moving objects, such as vehicles.

In other embodiment of the invention, the system keeps tracking of vehicles and persons. In such embodiment, the data processing means may include a program for creating service associations between persons and vehicles entities, indicating which entities may be serviced by any of the available entities. In such way, several rules can be created such as registering that an entity has received service from one service entity when the distance between both entities is lesser than a predefined distance.

Thanks to the high degree of customization of the worldwide tracking system of the present invention, it can be adapted to be used for several specific applications such as: monitoring the location of children or a group of children during school time or school trips, monitoring the location of members of a family inside a mall, across the country or during trips, monitoring the location of a company employees inside or outside an office, such as during business trips, monitoring the location of value trucks or rental cars, or any other application that needs monitoring the location of an object or person or a group of objects or persons.

Also, there are continuously released to the market new devices as GPS or Active RFID tags that allow the users to send a signal indicating certain request of service. The data processing means of the present invention may include a program for administering such requests and for searching service providers available and the location of said service providers as well as the requesters for administering the priority of the service according to different options of algorithms such as: by distance, by first requestor-first attended, by zone assigned to servers among others.

Finally, it must be understood that the worldwide tracking system of the present invention, is not limited exclusively to the embodiments above described and illustrated and that the persons having ordinary skill in the art can, with the teaching provided by the invention, to make modifications to the worldwide tracking system of the present invention, which will clearly be within of the true inventive concept and of the scope of the invention which is claimed in the following claims.

What is claimed is:

1. A tracking system for tracking the location of a plurality of persons, objects and groups of persons or objects or combination of persons and objects comprising:

a localizer associated to one person or object or group of persons or objects, or a group of persons and objects;

a network wirelessly connected to said localizer to receive localization information from said localizer;

a data processor having:

a database;

a display that displays the localization information; and a network access that accesses said network;

the date processor being arranged to:

create a worldwide virtual geographical grid including worldwide coordinates;

display a selected map overlaying the virtual geographical grid;

monitoring the localizer and obtaining localization information from said network;

display the localization information of the localizer in the selected map;

create associations between the localizer and persons, objects, groups of persons, objects, or groups of objects and persons and monitor the location of said associated persons, objects and groups of persons or objects and groups of persons and objects;

create multiple rules involving persons, objects, groups, locating means, times, dates, places, and generating alarms if said rules are violated;

download publicly available electronic worldwide maps from the network or local databases, and select a specific map in order to overlay said map over the virtual geographical grid;

edit said selected map in order to add custom virtual items including buildings or specific maps from the interior of buildings and any other objects, and save said objects as a part of a group of objects or individually in said computer database, so that the objects can be added or deleted from the map when necessary;

register and store in the database the localization history of the monitored localizer associated to a person, object or group and display on the display a path representing said registered localization history in the selected map;

display on the display further of the localizer that were near the monitored localizer at a predetermined time or date or between a selected period of time and date;

create user virtual accounts that include a list of the monitored and further localizers that a user wants to monitor, rules for sending alarms, preferences regarding the way the account is accessed by the user or by other users, including authorizations to other users to gain access to the account;

create distance associations between persons, objects or groups and creating rules based on said distance associations and generate an alarm if there is a violation of rules based on said distance associations including generating an alarm if said persons, objects or groups move closer or away a predetermined distance from each other, immediately or after the violation to the rule has repeated a predetermined number of times;

create restriction zones in the map for associating one or more persons, objects or groups to said created restriction zones and creating rules based on said restriction zones;

create service associations between entities including persons, objects, groups of persons or objects or groups of persons and objects, indicating which entities may be serviced by any of the available entities, and create service association rules including registering that an entity has received service from one service entity when the distance between both entities is less than a predefined distance; and administer wireless service requests made by users having localizers and search for available service providers and the location of said service providers as well as the requesters for administering the priority of the service according to different options of algorithms including: by distance, by first requestor-first attended, and by zone assigned to servers.

2. The tracking system in accordance with claim 1, wherein, the localizer comprises at least one of a GPS, a cellular phone, and an RFID chip, and said display is adapted to zoom in and out from said map.

3. The tracking system in accordance with claim 1, wherein the data processor further is adapted to monitor associations between a person or a group and one or more localization means and keep track of a specific person or group of persons when an associated said localizer stops sending a localization signal and a further localizer starts emitting a localization signal, by representing in the map the location of the further localizer and the person or object or group of person or objects associated thereof.

4. The tracking system in accordance with claim 1, wherein the data processor is further adapted to calculate distances between persons, groups or objects displayed in said selected map.

5. The tracking system in accordance with claim 1, wherein the data processor is further adapted to register and store in the database the localization history of each localizer associated to a person, object or group.

6. The tracking system in accordance with claim 1, wherein the data processor is further adapted to register and store in the database the localization history of each localizer associated to a person, object or group and to display on the display the localization history of a selected said localizer for a period of time or dates.

7. The tracking system in accordance with claim 1 wherein the data processor is further adapted to search for one or more persons or objects, or groups of persons or objects or groups of person and objects associated to respective localizers using a key word identifying a person, object or group or the identify information.

8. The tracking system in accordance with claim 1 wherein the data processor is further adapted to control user requests to access localization information of the persons, objects or groups of persons or objects or groups of persons and objects assigned to one said localizer, including allowing access to certain users with or without authorization.

9. The tracking system in accordance with claim 1 wherein the data processor is further adapted to generate an alarm if there is a violation of rules based on said restriction zones, including when one or more persons of a group leave the restricted zone at certain times or days or when other persons, objects or groups that do not pertain to said group enter the restricted zone.

10. The tracking system in accordance with claim 1 wherein the data processor is further adapted to create multiple rules involving persons, objects, groups, locating means, times, dates, places, restricted zones of one or more user accounts, including rules comprising establishing distance limits among persons during certain times and dates, or establishing that one or more persons or groups have to be present in a predefined zone before, at or after a certain time or date; and to generate an alarm if said multiple rules are violated.

11. A tracking method for tracking the location of a plurality of persons, objects and groups of persons or objects or combination of persons and objects comprising:

providing one or more localization means associated to one person or object or group of persons or objects, or a group of persons and objects said localization means wirelessly connected to a network and sending localization information to said network;

adding said localization means to a monitoring system for obtaining localization information from the added localization means by means of said network;

creating groups of persons or objects or groups of persons and objects for monitoring the localization of a group of persons or objects, or a group of persons and objects; creating customizable maps in which a plurality of virtual items can be created;

displaying in a worldwide map the location of each localization means or each person or object or selected group of persons or objects or groups of persons and objects associated with a localization means;

creating rules for generating alarms involving: distances among localization means; distances among persons or objects associated with localization means; distances among groups of persons or objects or groups of persons and objects: distances among localization means, persons or objects associated with localization means or groups of persons or objects or groups of persons and objects; distances among geographic regions, or among virtual items; times, dates, geographic zones or a combination thereof;

registering the localization history for each localization means associated to a person or object and displaying in a map the registered path of each localization means and to select period of time or dates to view the registered path between the selected times or dates;

registering the localization history for each localization means associated to a person or object and displaying in a map the localization means that were near one or more selected localization means at a predetermined time or date or between a selected period of time and date;

generating one or more alarms based on rules related on distance associations between persons, objects or groups, including generating an alarm if said associated groups or persons move closer or away a predetermined distance from each other, immediately or after the violation to the rule has repeated a predetermined number of times;

generating one or more alarms based on rules related to restriction zones in the map associated with one or more persons, objects; and administering service associations between persons, objects and groups entities, indicating which entities may be serviced by any of the available entities, and registering that an entity has received service from one service entity when the distance between both entities is lesser than a predefined distance in accordance with servicing rules.

12. The tracking method in accordance with claim 11, further comprising searching one or more persons or objects, or groups of persons or objects or groups of person and objects associated to added localization means or search for specific localization means or groups of localization means.

13. The tracking method in accordance with claim 11, further comprising generating an alarm when one or more persons of the group leave the restricted zone at certain times or days or when other locating means or persons associated with locating means that do not pertain to said group enter the restricted zone.

14. The tracking method in accordance with claim 11, further comprising automatically sending one or more alarms via notification means to one or more recipients based on multiple rules involving persons, objects or groups, locating means, times, dates, places.

15. The tracking method in accordance with claim 11, further comprising administering signals indicating requests of service sent by users having localization means and searching for service providers available and the location of said service providers as well as the requestors for administering the priority of the service according to different options of algorithms including: by distance, by first requestor, first attended, by zone assigned to servers among others.

* * * * *